US006725871B1

(12) United States Patent
Shearer et al.

(10) Patent No.: US 6,725,871 B1
(45) Date of Patent: Apr. 27, 2004

(54) PORTABLE COVER UNIT

(75) Inventors: Robert R. Shearer, Ellenton, FL (US); Kevin Stancil, Bradenton, FL (US); Terry Burk, Winter Springs, FL (US)

(73) Assignee: Nelson A. Taylor Co., Inc., Gloversville, NY (US)

( * ) Notice: Subject to any disclaimer, the term of this patent is extended or adjusted under 35 U.S.C. 154(b) by 131 days.

(21) Appl. No.: 10/162,710

(22) Filed: Jun. 6, 2002

Related U.S. Application Data

(63) Continuation-in-part of application No. 09/925,621, filed on Aug. 10, 2001, now Pat. No. 6,443,090.

(60) Provisional application No. 60/295,852, filed on Jun. 6, 2001.

(51) Int. Cl.[7] ..... E04H 15/06; E04H 15/36; E04H 15/64; B63B 17/00

(52) U.S. Cl. ..... 135/88.01; 135/88.13; 135/96; 135/125; 135/161; 114/361; 150/159; 150/166; 296/104; 296/136.12

(58) Field of Search ..... 135/88.01, 88.02, 135/88.09, 88.15, 96, 125, 161, 119, 120.3, 88 B; 114/361; 150/159, 166; 108/50.12; 296/104, 136.1, 136.11, 136.12

(56) References Cited

U.S. PATENT DOCUMENTS

| | | | | | |
|---|---|---|---|---|---|
| 2,816,297 | A | | 12/1957 | Stanley | |
| 3,176,699 | A | * | 4/1965 | Rollins | 135/120.3 |
| 3,223,098 | A | * | 12/1965 | Dole | 135/126 |
| 3,572,353 | A | | 3/1971 | Pinkley | |
| 3,604,440 | A | * | 9/1971 | Wilson | 114/361 |
| 3,955,228 | A | | 5/1976 | Gaschenko et al. | |
| 4,075,723 | A | | 2/1978 | Bareis et al. | |
| 4,184,501 | A | * | 1/1980 | Johnson | 135/88.08 |
| 4,533,170 | A | * | 8/1985 | Banks et al. | 296/77.1 |
| 4,560,196 | A | * | 12/1985 | Carter, Sr. | 296/102 |
| 4,657,299 | A | | 4/1987 | Mahan | |
| 4,671,203 | A | | 6/1987 | Sanburg | |
| 4,766,830 | A | | 8/1988 | Kunz | |
| 4,766,918 | A | * | 8/1988 | Odekirk | 52/2.23 |
| 4,951,594 | A | | 8/1990 | Feikema | |
| 4,979,457 | A | | 12/1990 | Sommerhauser et al. | |
| 5,070,807 | A | * | 12/1991 | Lewis | 114/361 |
| 5,088,438 | A | | 2/1992 | Richardson, Jr. et al. | |
| 5,339,851 | A | * | 8/1994 | Miller et al. | 135/88.05 |
| 5,441,066 | A | | 8/1995 | Harris | |
| 5,479,872 | A | | 1/1996 | Hulett | |
| 5,494,329 | A | * | 2/1996 | Gonzalez et al. | 297/184.13 |
| 5,546,971 | A | * | 8/1996 | Leonhardt | 135/127 |
| 5,927,311 | A | | 7/1999 | Jager | |
| 5,944,039 | A | * | 8/1999 | Bergeron | 135/119 |
| 6,026,761 | A | | 2/2000 | Parniske et al. | |
| 6,129,034 | A | | 10/2000 | Santa Cruz et al. | |
| 6,257,261 | B1 | * | 7/2001 | Johnson | 135/96 |
| 6,286,449 | B1 | | 9/2001 | Giffin et al. | |
| 6,443,090 | B1 | * | 9/2002 | Giffin et al. | 114/361 |
| 6,454,340 | B1 | * | 9/2002 | Miller et al. | 296/104 |
| 6,467,107 | B1 | * | 10/2002 | Glover et al. | 5/99.1 |

FOREIGN PATENT DOCUMENTS

| | | |
|---|---|---|
| WO | WO 94/06676 | 3/1994 |

* cited by examiner

*Primary Examiner*—Robert Canfield
(74) *Attorney, Agent, or Firm*—Nixon & Vanderhye P.C.

(57) ABSTRACT

A portable cover unit includes a fabric cover supported by a flexible frame. The fabric cover has sleeves that secure members of the flexible frame, which is constructed with primary frame members extending in a first direction and at least one secondary frame member extending in a second substantially perpendicular direction between the primary frame members. A plurality of connectors are attachable to an object to which the portable cover unit is installed, each including an aperture sized to receive the primary frame members. Structure is also provided for securing the fabric cover to the object to which the portable cover unit is installed. The portable cover unit can be mounted to any open portion of a vehicle such as a boat, golf cart or the like or can be used independently. The structure can be readily disassembled and stored in a compact package.

19 Claims, 13 Drawing Sheets

PORTABLE COVER UNIT

CROSS-REFERENCES TO RELATED APPLICATIONS

This application is a continuation-in-part of U.S. patent application Ser. No. 09/925,621, filed Aug. 10, 2001, and this application claims the benefit of U.S. Provisional Patent Application Ser. No. 60/295,852, filed Jun. 6, 2001 now U.S. Pat. No. 6,443,090, the entire contents of which are herein incorporated by reference.

STATEMENT REGARDING FEDERALLY SPONSORED RESEARCH OR DEVELOPMENT (NOT APPLICABLE)

BACKGROUND OF THE INVENTION

The present invention relates to vehicle accessories and, more particularly, to a portable cover unit that is readily attachable to vehicles such as boats, golf carts, etc. that provides a portable enclosure for an open section of the vehicle.

Cover structures currently exist that are attachable to boats and the like to enclose the rear portion of the boat from inclement weather. It has been known to secure the cover structures with permanently-attached supporting hardware as well as with supporting hardware that connects to existing snap members present on the boat hull. Typical cover structures, however, have primarily been limited to covering the back or transom of the boat. Additionally, the cover structures have not been suitable for other vehicles such as golf carts and the like. Still further, conventional cover structures have not been independently usable, for example as a tent structure on the ground or the like.

BRIEF SUMMARY OF THE INVENTION

The present invention is constructed to be mountable to either the front or rear of a boat or other vehicle as shown in the attached figures. Additionally, as also shown, the cover unit of the invention can be used as a stand-alone cabana or the like, providing a portable enclosure for numerous applications.

The features of the invention described herein are particularly related to its application to the front or bow of a boat, the rear of a golf cart, and independently, although those of ordinary skill in the art will contemplate alternative applications, and the invention is not meant to be limited to the described applications.

In an exemplary embodiment of the invention, a portable cover unit is attachable to an open portion of a structure including a main frame. The portable cover unit includes a fabric cover having an outer perimeter and an inside surface, which fabric cover is sized to cover the open portion of the structure. A plurality of frame attaching members are securable to the structure, and a flexible frame is attachable to the structure via the frame attaching members. The flexible frame includes at least two longitudinally extending primary frame members releasably attachable at ends thereof to the frame attaching members, and at least one laterally extending secondary frame member releasably attachable at ends thereof between the primary frame members. The fabric cover includes a plurality of frame connectors fixed to the inside surface thereof, and structure associated with the outer perimeter that is coupleable with the main frame of the structure, with the flexible frame being removably secured to the fabric cover via the frame connectors.

The frame attaching members may comprise at least one flange including an opening for receiving a connector and a receiving channel for releasably supporting the ends of the primary frame members. The primary frame members are preferably formed of flexible tubing having a cross-sectional shape, where the at least one secondary frame member comprises end connectors at the ends thereof of a shape corresponding to the cross-sectional shape of the primary frame members and sized such that the end connectors are engageable with the primary frame members in a snap fit. In this context, the end connectors may be press-fit onto the ends of the secondary frame member.

In one embodiment, the frame connectors comprise sleeves sewn to the inside surface of the fabric cover, the sleeves being sized to receive the primary frame members. The sleeves may comprise a first fabric strip with one half of a hook and loop fastener material and a second fabric strip with the other half of the hook and loop fastener material, where the first and second strips are hooked together to form the sleeves.

The structure associated with the outer perimeter that is coupleable with the main frame of the structure comprises a cover connector releasably attachable to the main frame of the structure. In one embodiment, the cover connector comprises one half of a snap connector, wherein the other half of the snap connector is secured to the main frame of the vehicle. Alternatively, the cover connector may comprise a suction cup secured at an end of a strap attached to the fabric cover outer perimeter. In one arrangement, the main frame is ground, and the cover connector comprises a stake receptacle formed at an end of a strap attached to the fabric cover outer perimeter, the stake receptacle receiving a stake for securing the portable cover unit to the ground.

The structure may be a boat, with the main frame being the boat hull. In this context, a forward portion of the fabric cover may include a zipper for connecting with a brow bar of the boat. At least one of the frame attaching members includes a brow bar connector fixed to the brow bar, the brow bar connector including an aperture therein that is sized to receive the primary frame members.

Preferably, the fabric cover comprises at least one transparent window.

In another exemplary embodiment of the invention, a portable cover unit includes a fabric cover supported by a flexible frame, the fabric cover having sleeves that secure members of the flexible frame, wherein the flexible frame comprises primary frame members extending in a first direction and at least one secondary frame member extending in a second direction substantially perpendicular to the first direction between the primary frame members. The portable cover unit also includes a plurality of connectors attachable to an object to which the portable cover unit is installed, the connectors each comprising an aperture sized to receive the primary frame members, and structure for releasably securing the fabric cover to the object to which the portable cover unit is installed.

In still another exemplary embodiment of the invention, a portable cover unit includes a fabric cover supported by a flexible frame, the fabric cover having sleeves that secure members of the flexible frame. A plurality of connectors attachable to an object to which the portable cover unit is installed each includes an aperture sized to receive the members of the flexible frame. The cover unit also includes structure for releasably securing the fabric cover.

BRIEF DESCRIPTION OF THE DRAWINGS

These and other aspects and advantages of the present invention will be described in detail with reference to the accompanying drawings, in which.

DETAILED DESCRIPTION OF PREFERRED EMBODIMENTS

As noted above, the description of the invention is particularly related to its application to the front or bow of a boat, the rear of a golf cart and independently. Those of ordinary skill in the art will contemplate alternative applications, and the invention is not meant to be limited to the described applications. In addition, the frame structure, fabric and attaching means can either be custom constructed according to particular vehicle specifications, or alternatively can be constructed as a production unit. Both arrangements are intended to be encompassed by the present invention.

Figure 1:
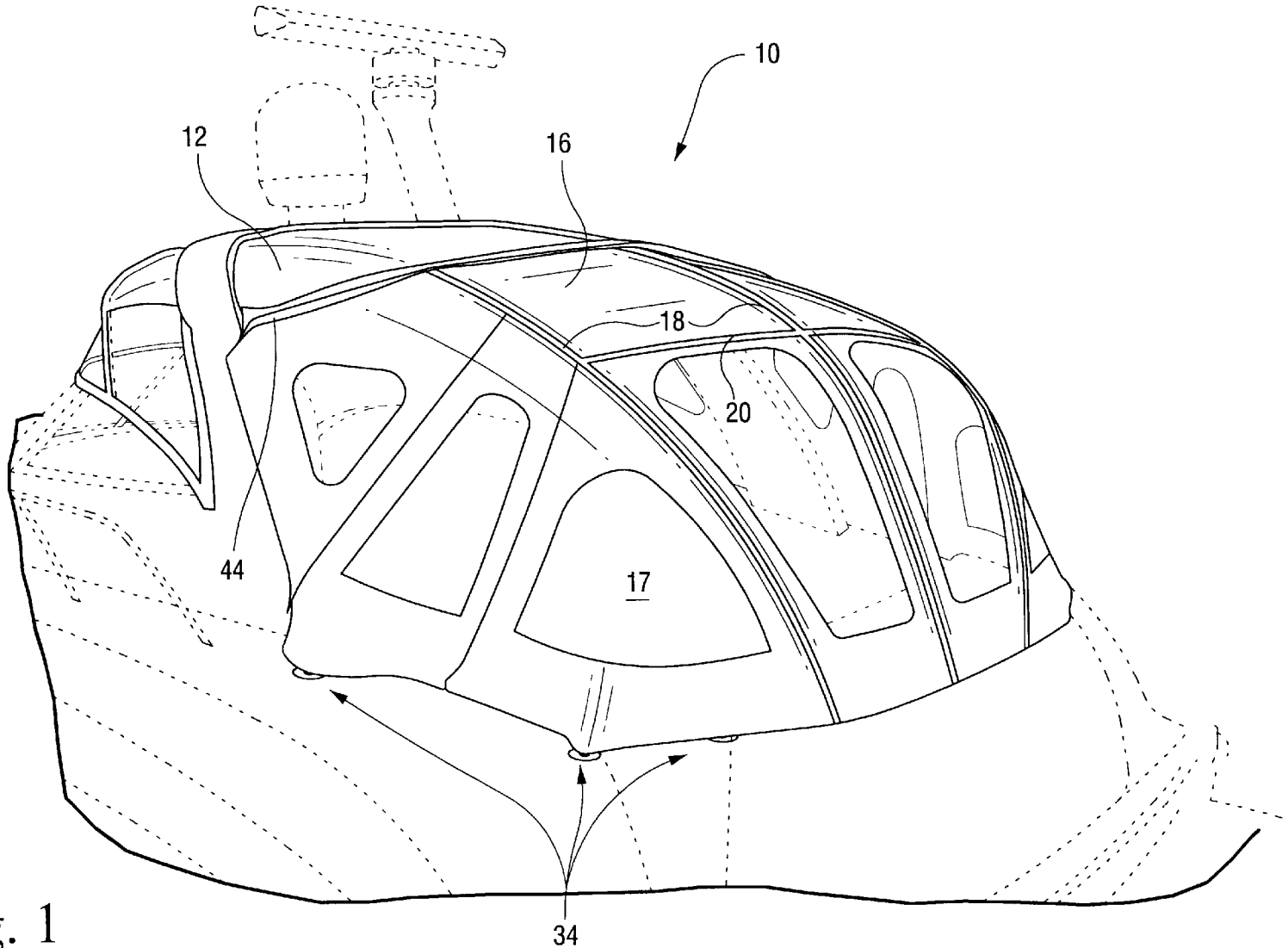
FIG. 1 is a perspective view of the portable cover unit secured to the brow bar on the stern of a boat.
Figure 2:
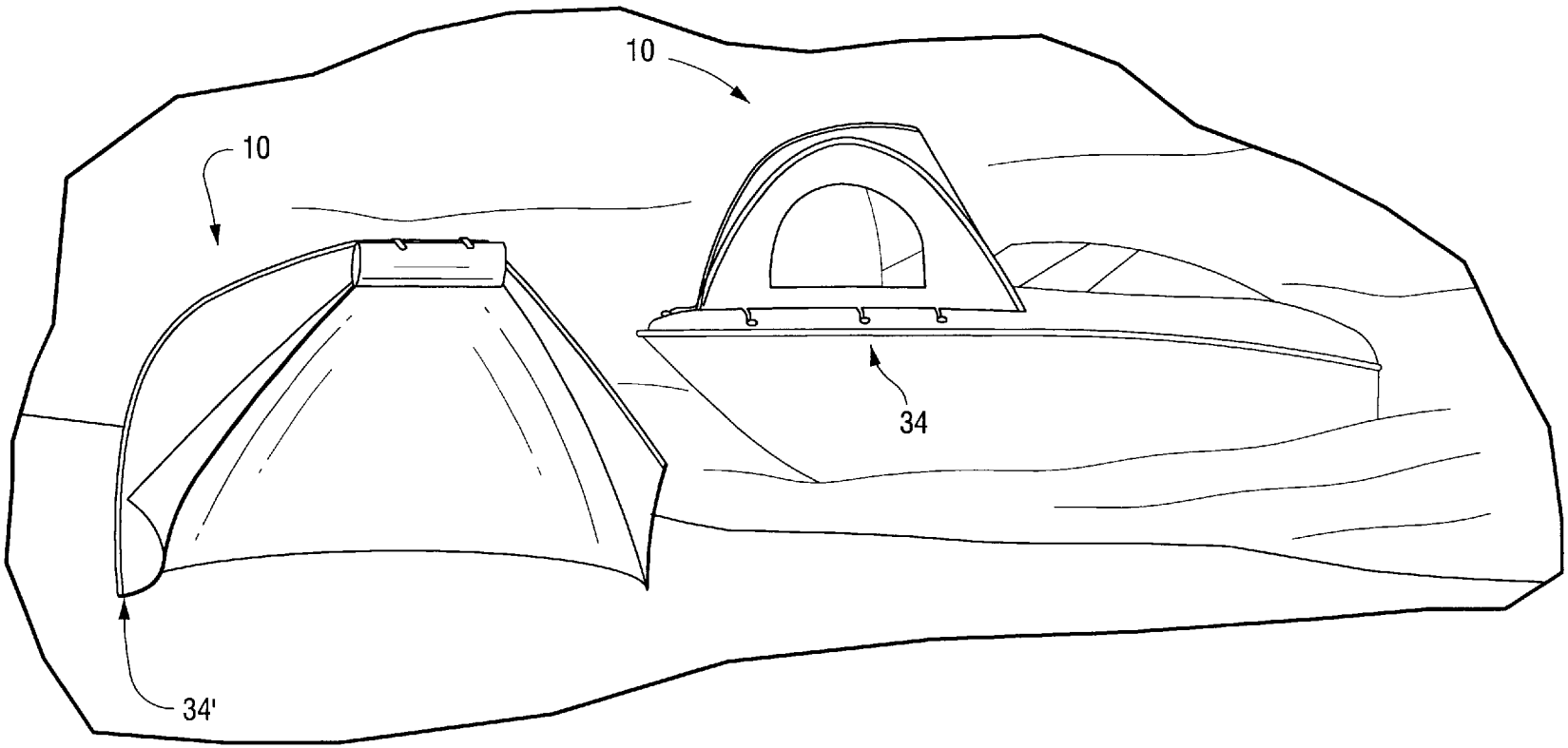
FIG. 2 shows the portable cover unit of the invention mounted on the bow of a boat and being used independently.
Figure 3:
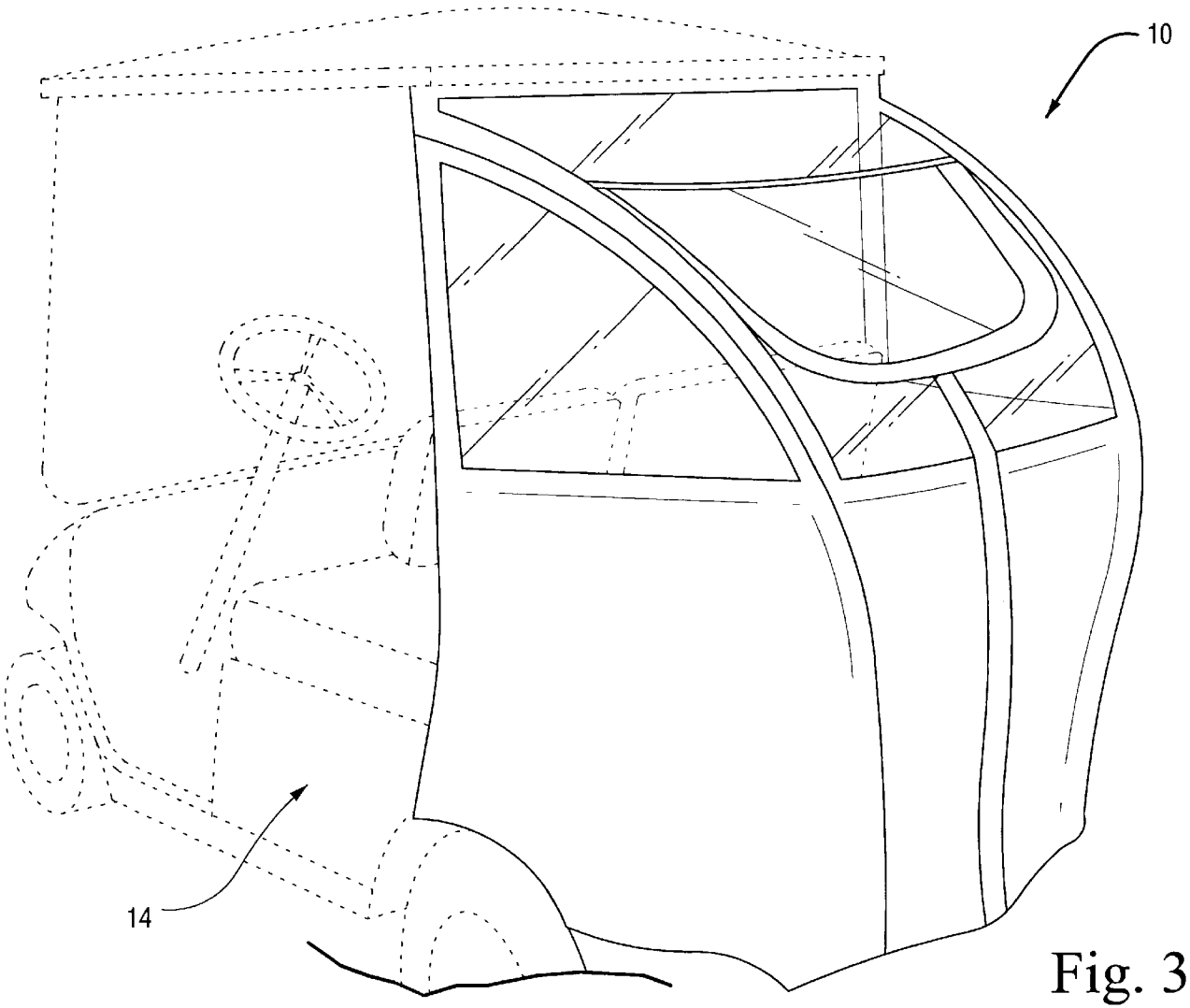
FIG. 3 is a perspective view of the portable cover unit mounted on a golf cart.

FIGS. 1–3 show various applications of the portable cover unit 10 according to the present invention. In FIG. 1, the cover unit 10 is mounted through a brow bar attachment 12 to the brow bar of a boat on the boat stern. FIG. 2 shows the cover unit 10 mounted on a boat bow and being used independently. FIG. 3 illustrates the cover unit 10 mounted on a back side of a golf cart 14.

Figure 4:
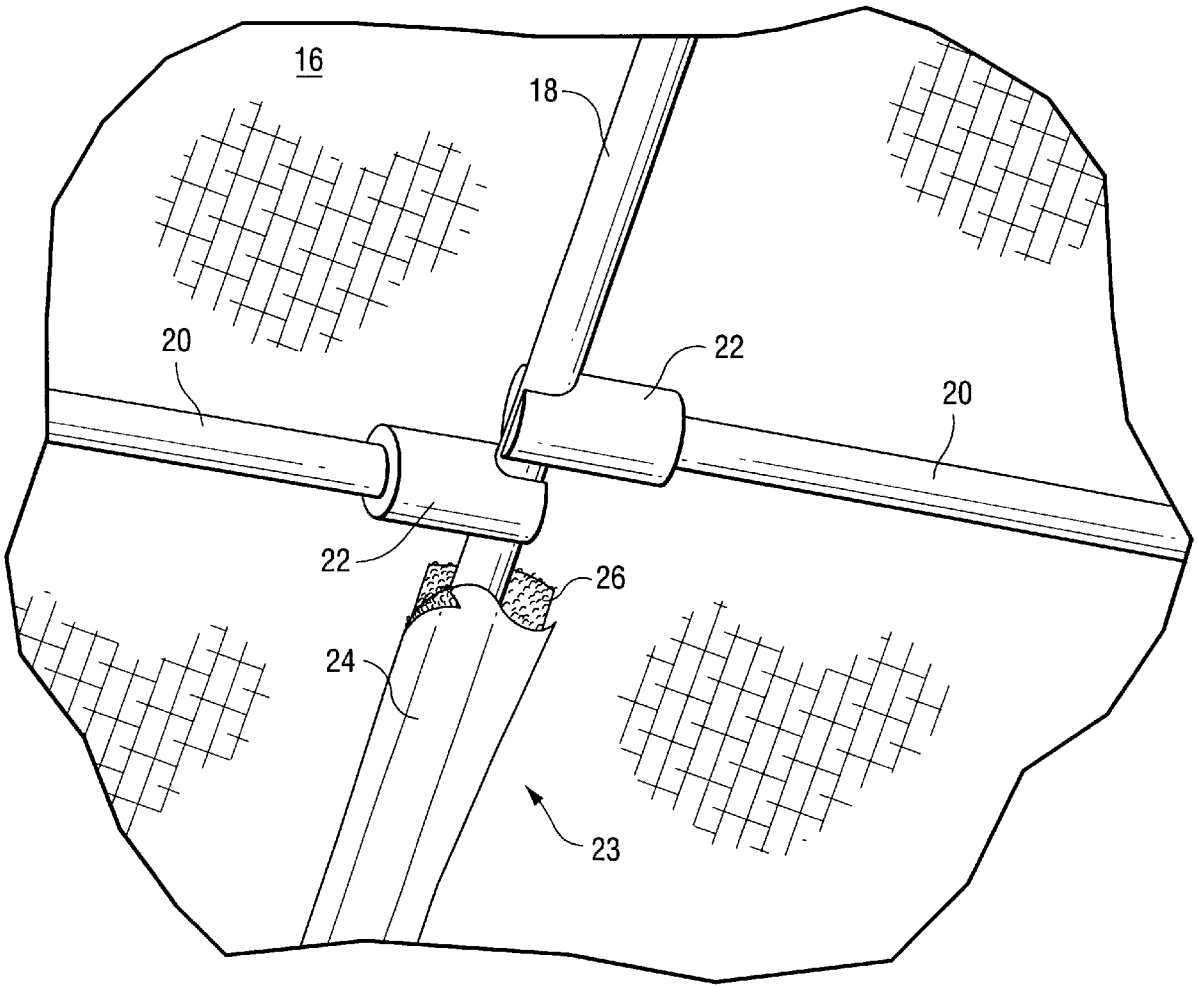
FIG. 4 is a close-up view of the portable cover unit frame construction.

The general construction of the cover unit 10, with continued reference to FIG. 1 and with reference to FIG. 4, includes a flexible frame supporting a fabric cover 16, with both the flexible frame and fabric cover 16 secured to the vehicle upon which the cover unit 10 is installed. The fabric cover is preferably formed of canvas, lightweight nylon, polyester, or other material suitable for the described purpose and is generally provided with one or more transparent windows 17. The flexible frame is generally constructed of a plurality of frame or pole members, generally including two or more primary frame members 18, extending in a longitudinal direction of the cover unit 10, and at least one laterally extending secondary frame member 20. The primary frame members 18 are releasably secured in suitable connectors (described below) attached to the vehicle, and the secondary frame members 20 are releasably attachable at ends thereof between the primary frame members 18.

The flexible frame may be alternately constructed as would be apparent to those of ordinary skill in the art. For example, the frame may include only a single longitudinal member with cross-member(s) extending across an entire width of the mounting structure. Additionally, the frame members may extend diagonally with or without supporting cross members. In one basic construction, the frame may include a single primary frame member and a single secondary frame member each extending in different directions across the mounting structure to support the fabric cover. These single members may or may not be secured together using a suitable connector. Exemplary alternative frame constructions are shown in FIGS. 7A–7G.

As shown in FIG. 4, the secondary frame members 20 are provided with end connectors 22 at ends thereof having a C-shape or complementary-shaped opening corresponding to a cross-sectional shape of the primary frame members 18. In this manner, the end connectors 22 of the secondary frame members 20 can be releasably secured between primary frame members 18 in a snap fit. Generally, the primary frame members 18 and the secondary frame members 20 are substantially perpendicularly oriented, although other configurations can be contemplated for example by providing the end connectors 22 with a swivel connection or the like.

The secondary frame members 20 serve as separator bars to keep two or more substantially parallel primary frame members 18 separated at a specified distance, thereby increasing the strength of the overall structure. Additionally, the secondary frame members 20 provide an outward force to be exerted on the primary frame members 18 to prevent the assembly from collapsing when opening the structure.

The primary and secondary frame members that make up the flexible frame are generally formed of hollow tubular aluminum support poles, thereby providing high strength to weight ratio in a lightweight package. Additionally, aluminum is non-splintering and can be provided with a UV stable hard coat anodized finish to retain color for extended periods of time. Additionally, the frame members can be provided in a variety of pole diameters and stiffness enabling correct structure stiffness for the application. By providing hollow tubing, the frame members, particularly the primary frame members, can be constructed in multiple pieces that may be shock-corded together for easy assembly and disassembly and storage in a compact package. Moreover, aluminum tubes allow for full round deburring of tube ends, thereby minimizing abrasions to the shock cord. Still further, the aluminum tubing can be pre-bent to reduce the stress on the poles.

With continued reference to FIG. 4, the fabric cover 16 is provided with a plurality of longitudinally disposed frame connectors 23 for attachment to the primary frame members 18. The frame connectors 23 are generally configured as sleeves that receive the primary frame members 18, although any suitable construction for securing the frame members 18 can be used. For example, the sleeves may be sewn into the fabric, extending along most of the length of the cover unit 10, with openings for securing the end connectors 22 of the secondary frame members 20. Alternatively, the sleeves may be constructed including a first fabric strip 24 with one-half of a hook and loop fastener material and a second fabric strip 26 with the other half of the hook and loop fastener material, wherein the first 24 and second 26 strips are hooked together to form the sleeves. With this construction, the fabric cover 16 can be easily secured and removed from the flexible frame. In still another arrangement, the sleeves may be formed using string or like material to support frame members 18.

Figure 5:
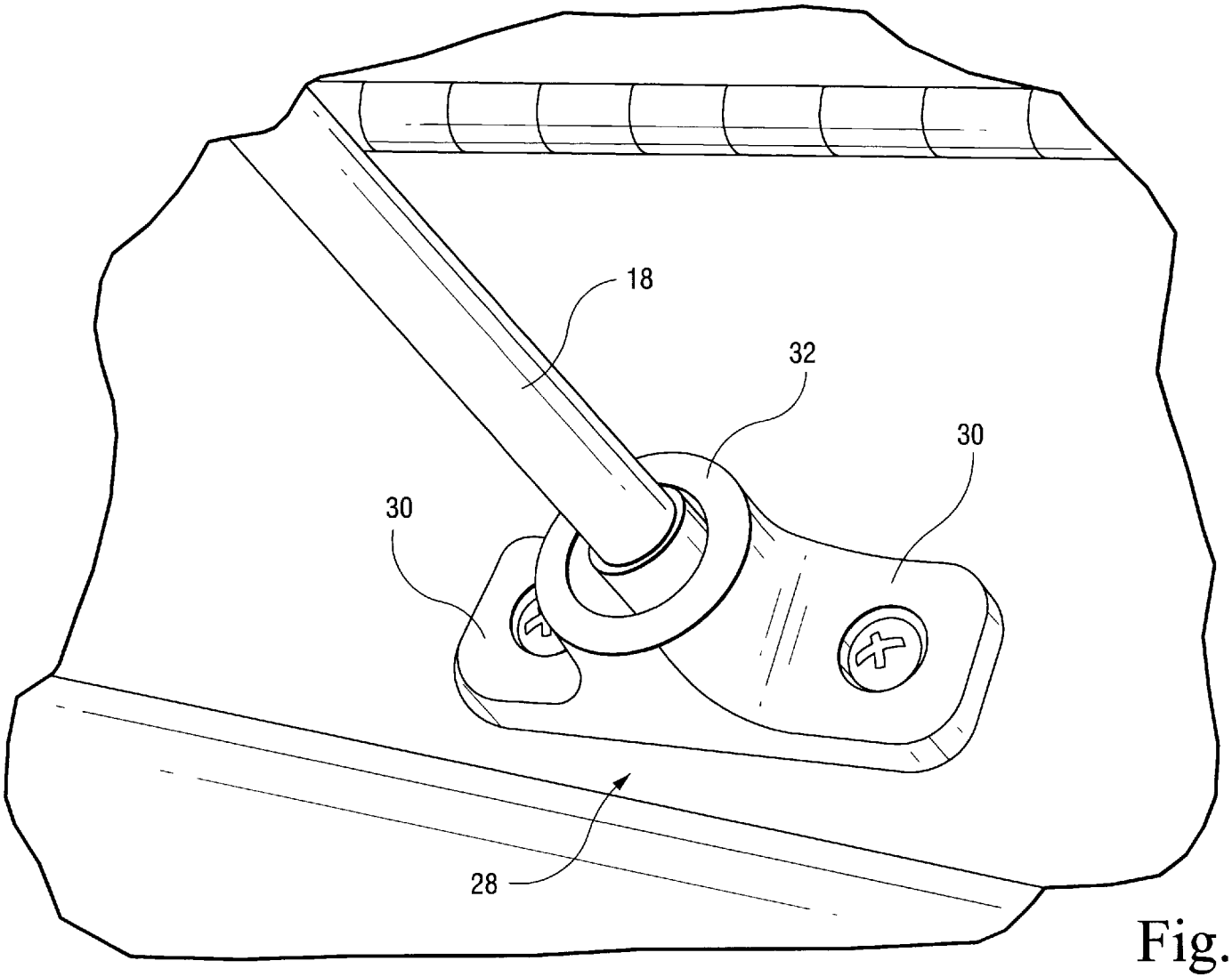
FIG. 5 shows an exemplary connector for removably securing the cover unit frame to a vehicle.

FIG. 5 shows a frame attaching member 28 secured to the vehicle structure by screws or the like. The frame attaching member 28 includes at least one flange 30, preferably two, including an opening for receiving a connector such as a screw or the like as shown, and a receiving channel 32 for releasably supporting the ends of the primary frame members 18. The number of frame attaching members 28 secured to the vehicle or other structure is dependent on the number of primary frame members 18 used to construct the flexible frame as well as the manner in which the cover unit 10 is mounted to the vehicle. The primary frame members 18 are constructed of a length such that when installed in the frame attaching members 28 or the like, the primary frame members 18 are slightly flexed to provide a bowed shape to the cover unit 10. See, for example, FIG. 1.

To complete the assembly, the fabric cover 16 is secured to a frame of the structure to which the portable cover unit 10 is being installed. Generally, an outer perimeter of the fabric cover 16 is provided with structure that is coupleable with the main frame of the structure to which the portable cover unit is being installed. For example, a cover connector 34 may comprise a snap connector as shown in FIG. 1, suction cups secured at an end of a strap attached to the fabric cover outer perimeter as shown in FIG. 2, or the like. In the snap connector arrangement shown in FIG. 1, one-half of a conventional snap connector is sewed or otherwise secured to the fabric cover outer perimeter, and a complementary half of the snap connector is secured to the vehicle frame via any suitable means such as screws or the like. With the suction cup arrangement shown in FIG. 2, the vehicle does not require any additional structure to mount the portable cover unit 10. Of course, those of ordinary skill in the art will contemplate alternative connectors between the fabric cover 16 and the structure to which the portable cover unit 10 is being mounted, and the application is not necessarily meant to be limited to the described examples. In the embodiment where the portable cover unit 10 is used independently, with reference to FIG. 2, the "main frame" is ground, and the cover connector 34' may include a stake receptacle formed at an end of a strap attached to the fabric cover outer perimeter. In use, the stake receptacle receives a stake for securing the portable cover unit to the ground.

An alternative canopy mounting structure that is suitable for the cover unit 10 according to the present invention is described in U.S. Pat. No. 6,026,761, which is hereby incorporated by reference.

Figure 6:
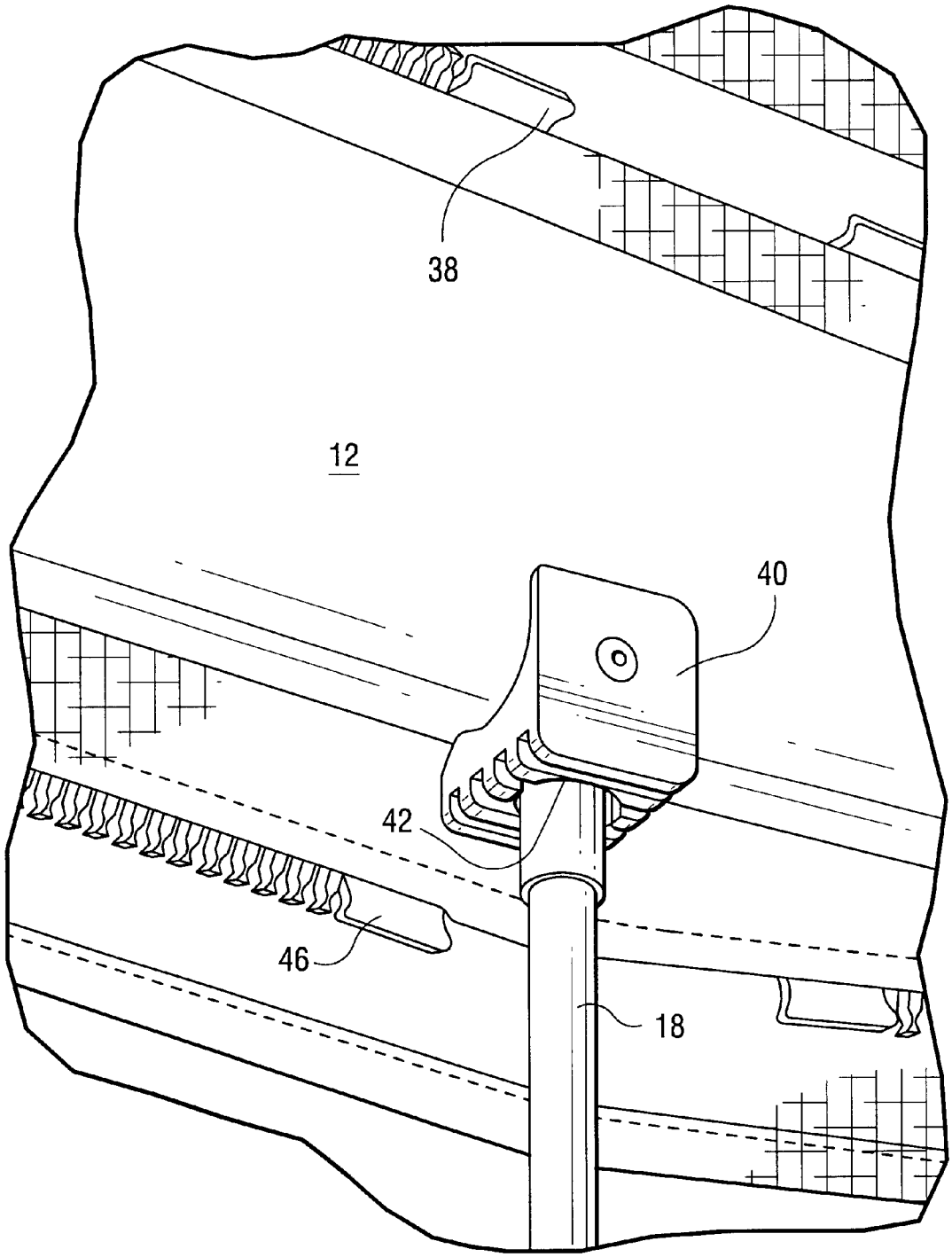
FIG. 6 shows the cover unit frame supported by a brow bar connector adjacent a boat brow bar.
Figure 7A:
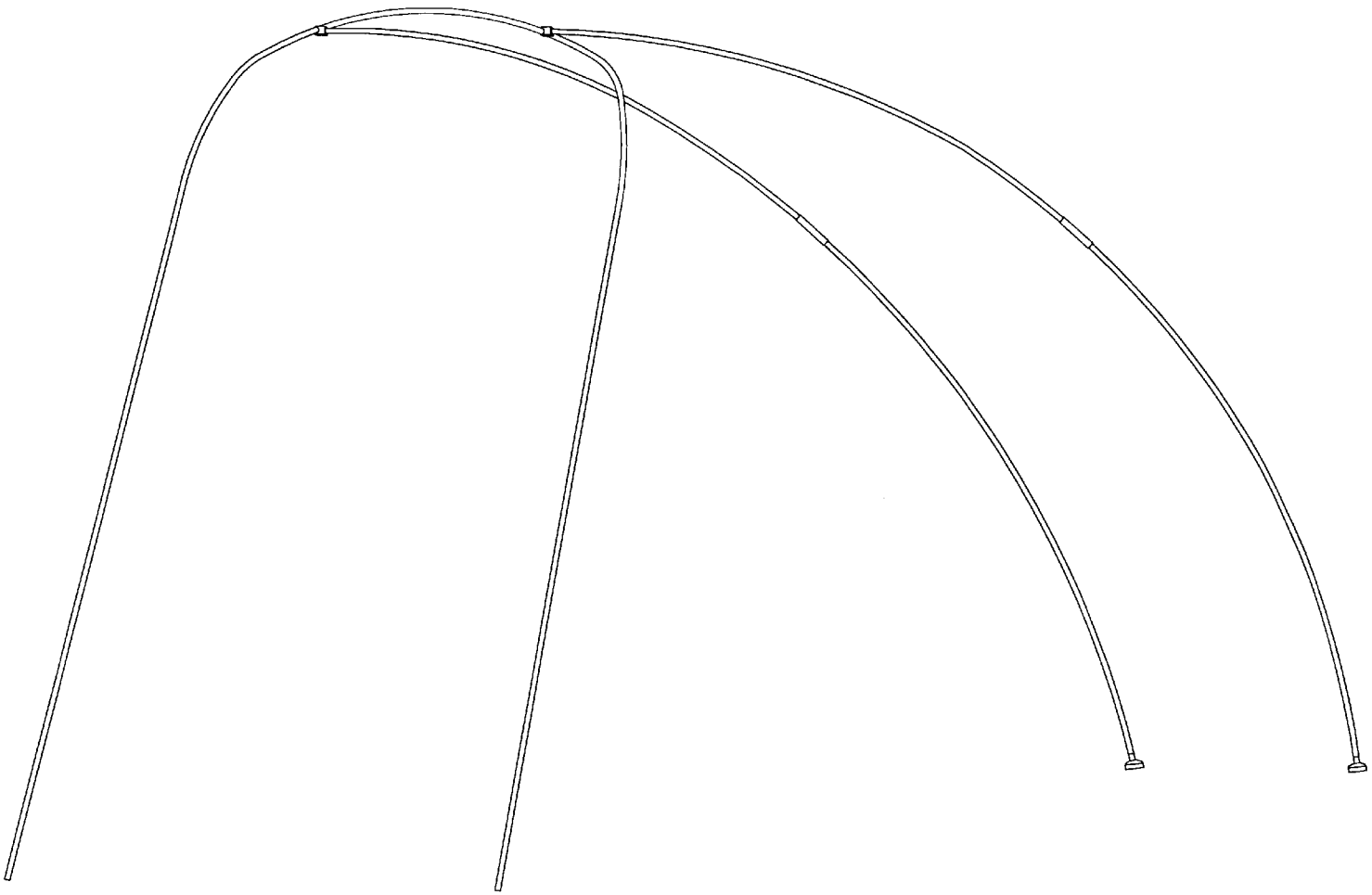
FIGS. 7A–7G show exemplary alternative frame constructions.
Figure 7B:
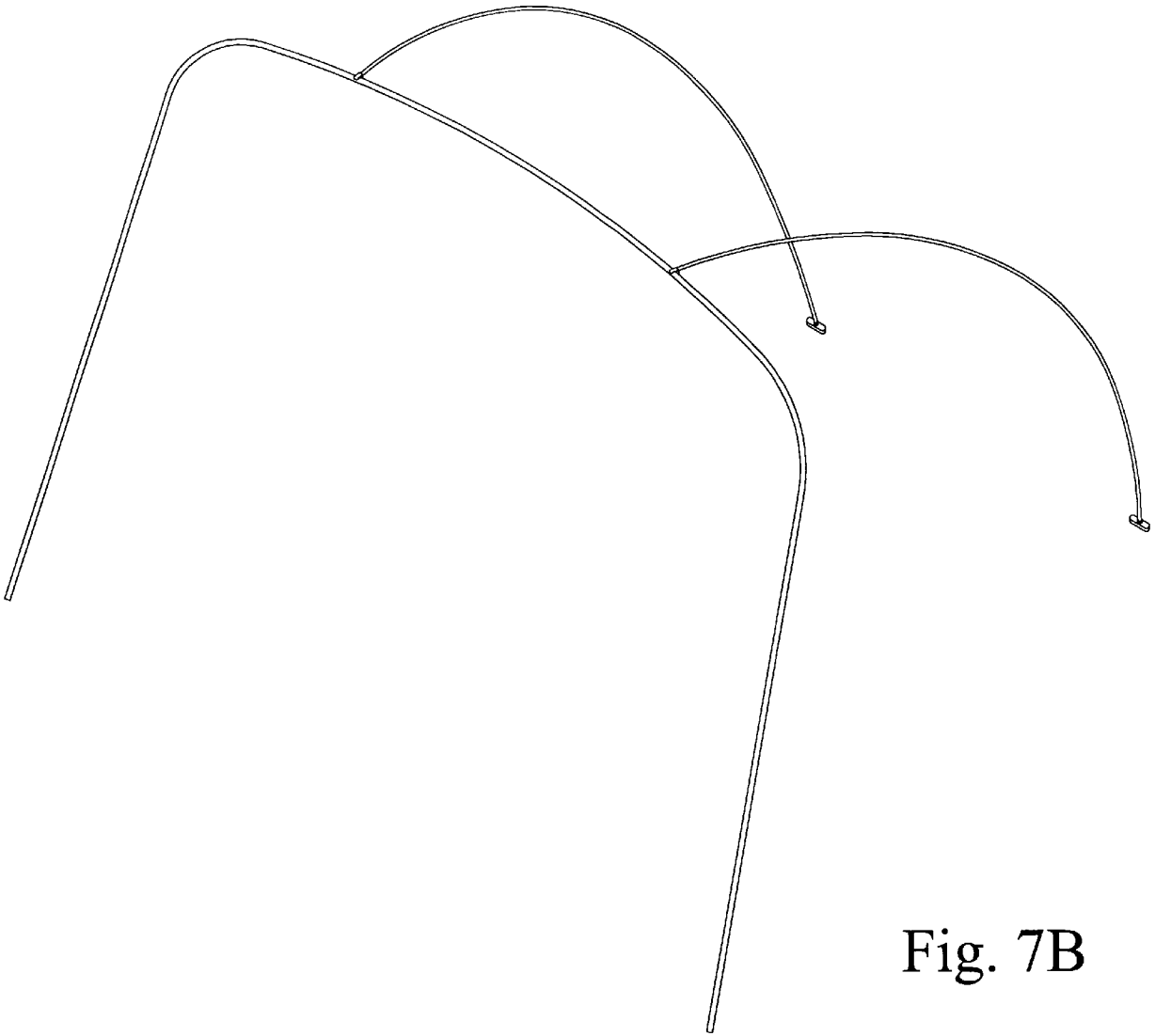
Figure 7C:
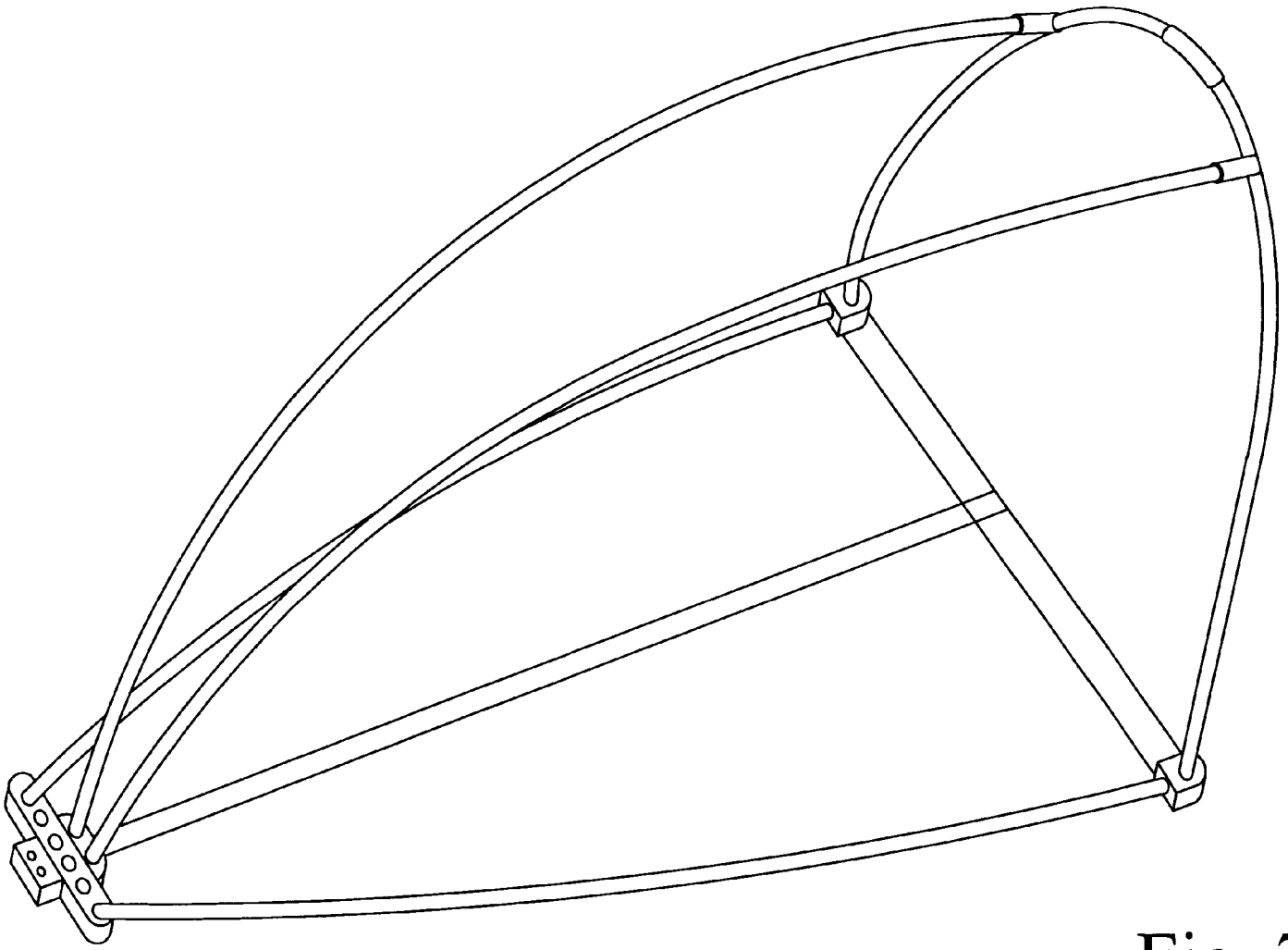
Figure 7D:
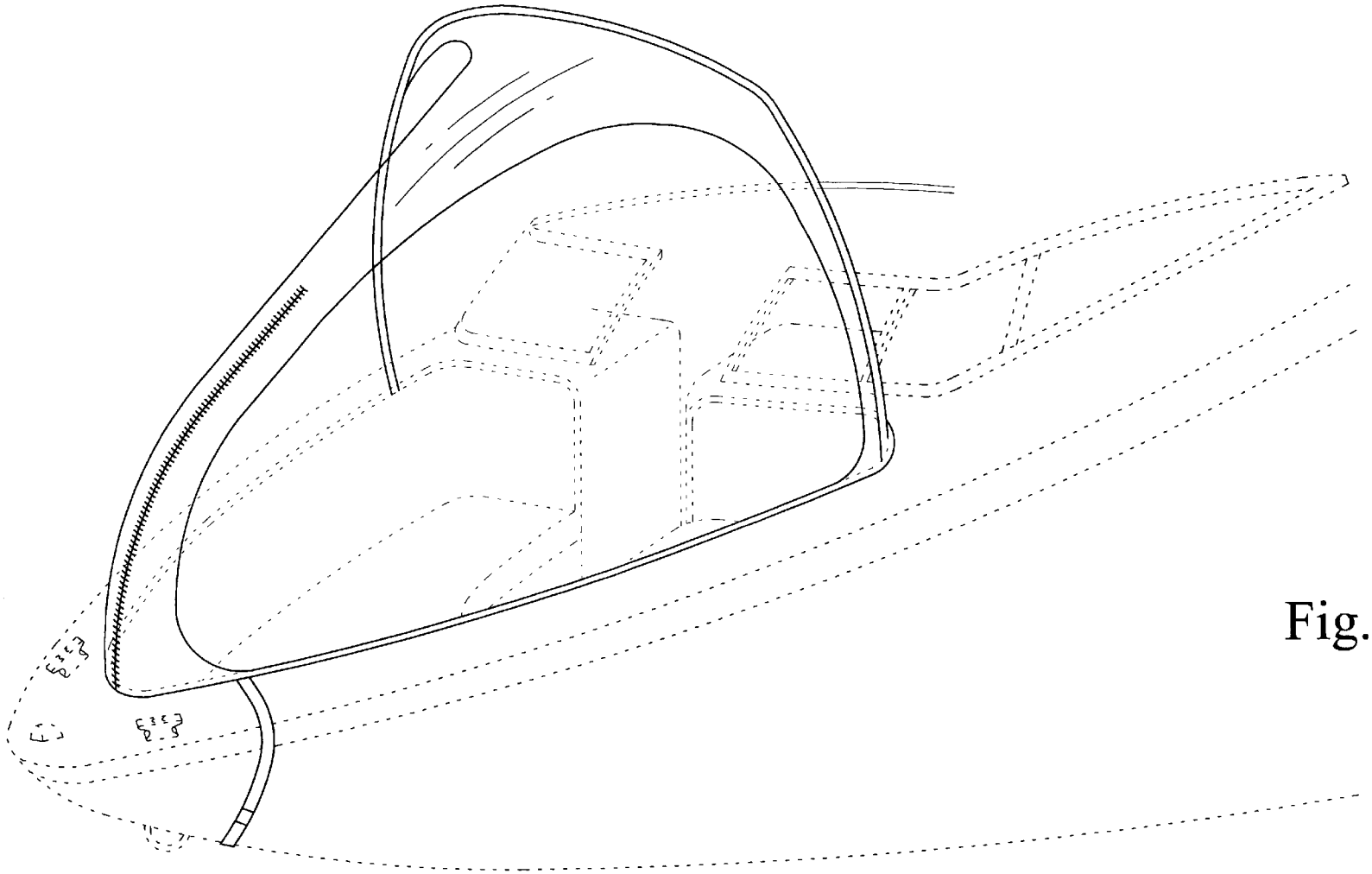
Figure 7E:
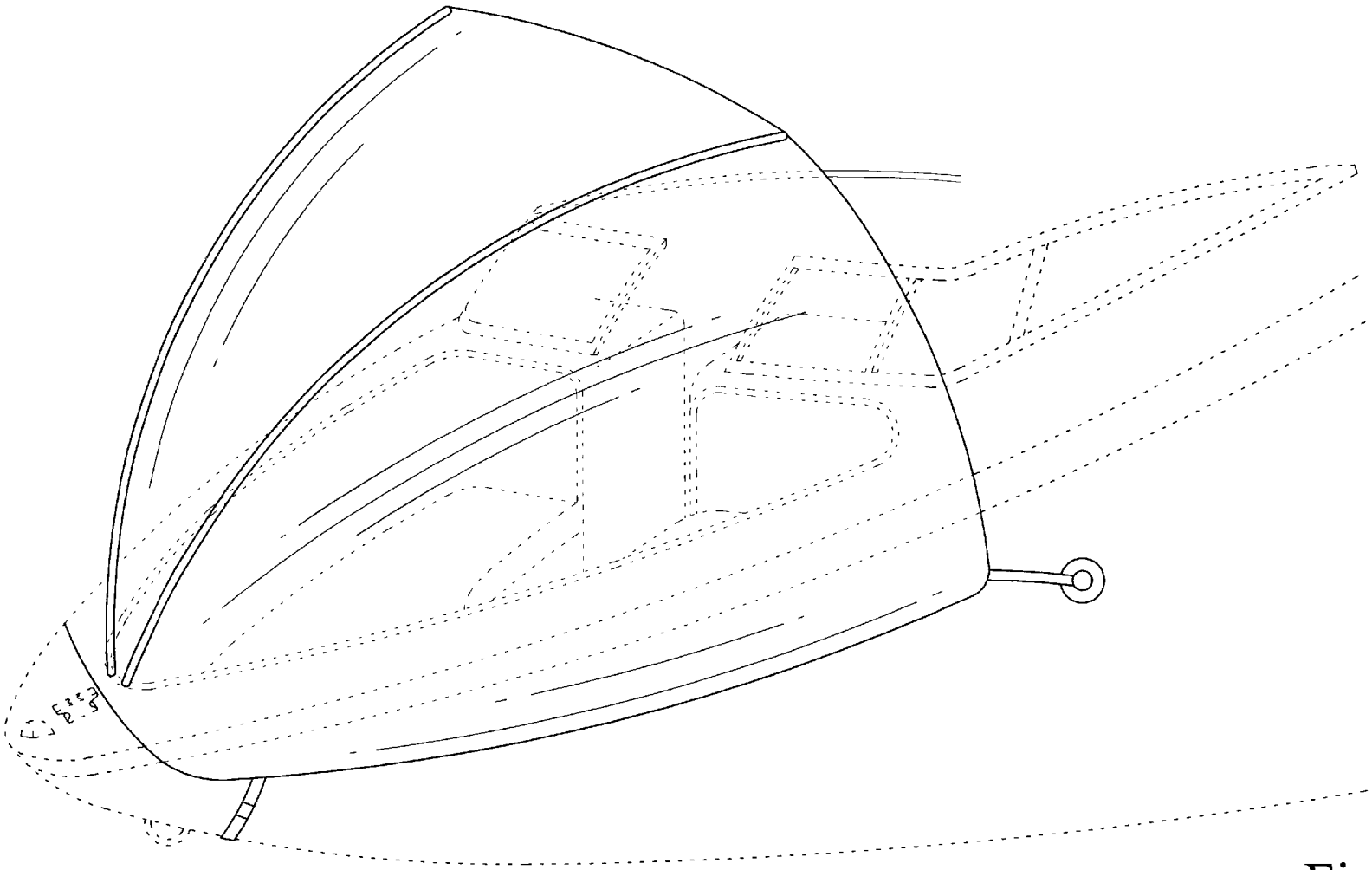
Figure 7F:
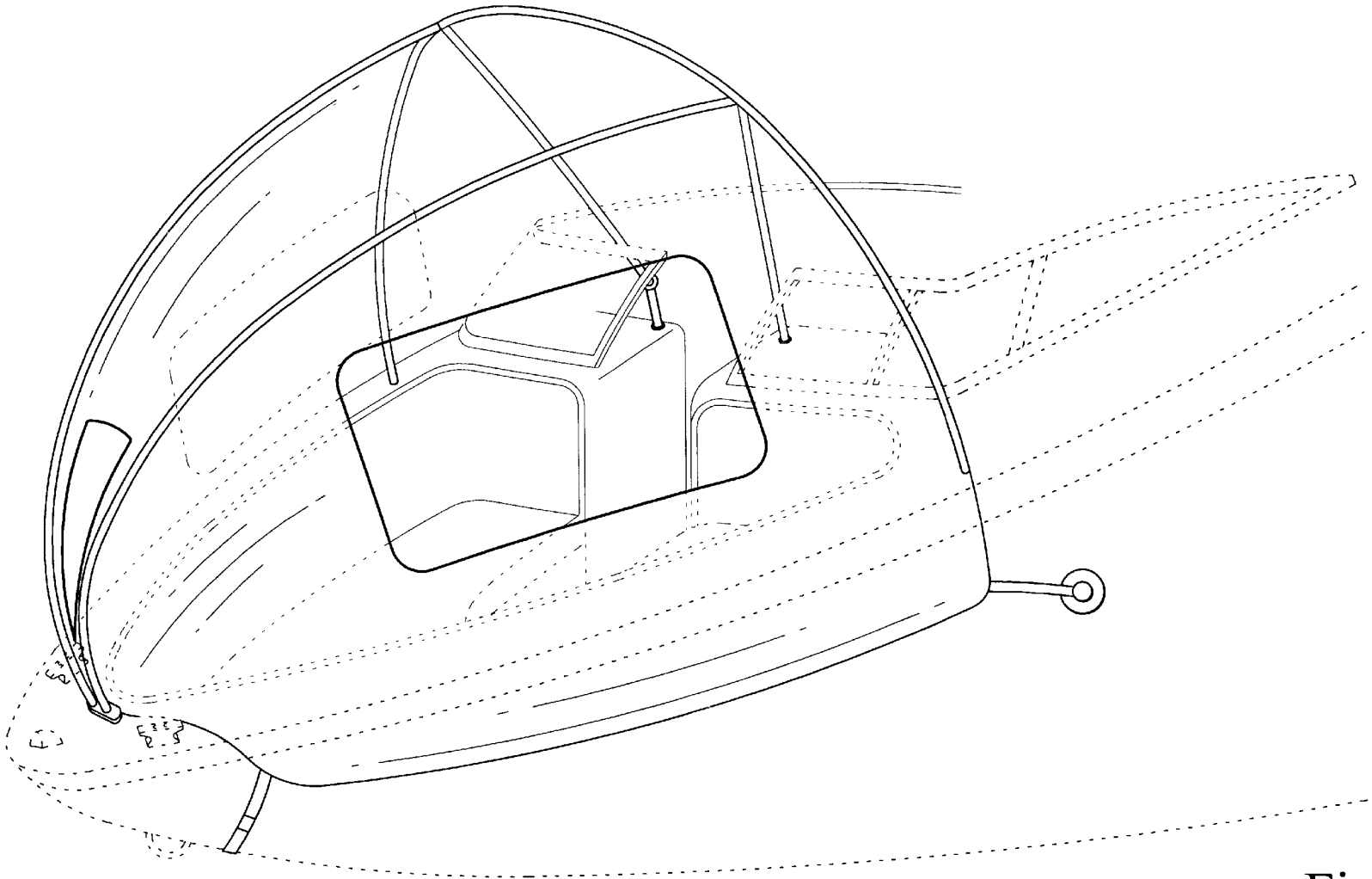
Figure 7G:
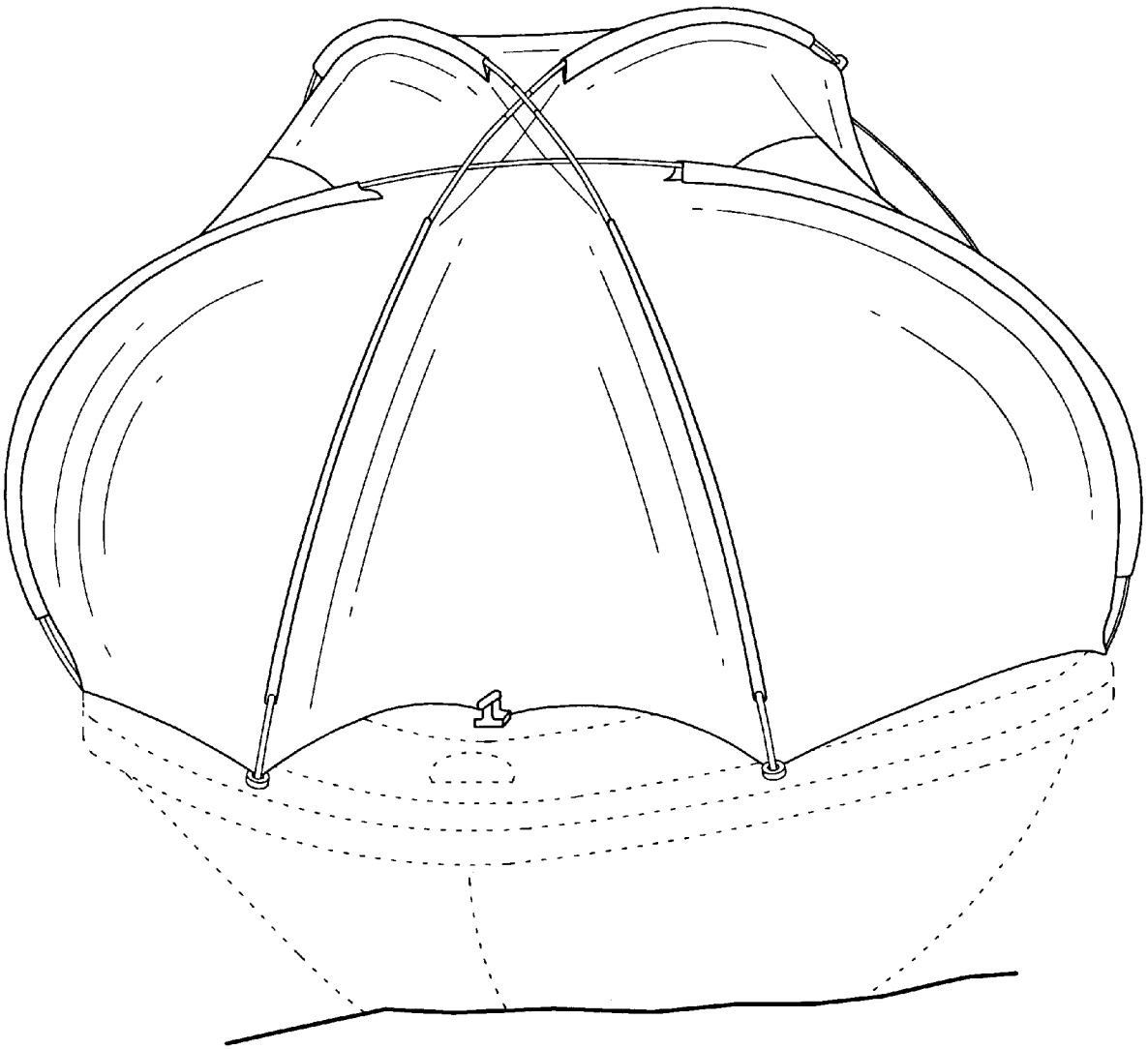

In one preferred embodiment of the present invention, with reference again to FIG. 1, the portable cover unit 10 can be configured to connect at its front end with a conventional brow bar attachment 12 in a boat. A similar connection can be made to a boat arch using a conventional canvas welt within the fabric attachment including a zipper connector or other suitable connector for the portable cover unit 10. This conventional zipper connector 38 is partially shown in FIG. 6. In this arrangement, at least one of the frame attaching members includes a brow bar connector 40 fixed to the brow bar attachment 12 or the like via a suitable securing means such as the rivet shown in FIG. 6. The brow bar connector 40 includes an aperture 42 therein that is sized to receive the primary frame members 18. The fabric cover 16 is then provided at its front end with one-half of a zipper connector 44 or the like for attachment to a complementary zipper portion 46 of the conventional brow bar attachment 12. Providing zippers on the front faces of an aft enclosure allows for normal and emergency access to the bow without requiring removal of the enclosure. Of course, the front end of the fabric cover 16 could also be provided with other connectors such as snaps or the like to be secured to complementary connectors provided on the brow bar attachment 12.

The following alternatives can be considered in preparing a custom construction:

Rail/Bow Mount Fitting

Provides for attachment of poles to the rails of a boat.

Provides for attachment of poles to a boat bimini top or brow top.

Provides for attachment of poles to any tubular cross-section for which the mount has been tooled.

Can be utilized as designed or modified to mount to after market bimini or brow canvas tops.

Self-draining feature to prevent water build-up in pole insert location.

Side Mount—Vertical Fitting

Provides for attachment of poles to side or hull of boat deck.

Provides for attachment of poles to boat arch.

Provides for shock cord locking of pole within the fitting. This feature prevents pole from being accidentally removed from the pole insert location.

Self-draining feature to prevent water build-up in pole insert location

Basic Deckmount Fitting

Provides for attachment of pole to topside of boat deck.

Provides for attachment of pole to vertical face of a boat arch.

Provides for attachment of pole to any support structure of a golf cart.

Self-draining feature to prevent water build-up in pole insert location.

Deckmount—Snap-Fit—Housing Fitting

Provides for attachment of pole to boat deck with a "ball & socket" type fit.

Provides for attachment of pole to boat arch with a "ball & socket" type fit.

Provides for attachment of pole to golf cart vertical support member with a "ball & socket" type fit.

Provides for attachment of pole to golf cart horizontal support member with a "ball & socket" type fit.

Provides for attachment of pole to any support surface with a "ball & socket" type fit.

Fitting is used w/Deckmount—Insert—Ball & Socket, Snap Insert for Deckmount, and Ball End w/Shank fittings.

Fitting could be made out of various materials included but not limited to plastic, stainless steel and zinc die cast.

Self-draining feature to prevent water build-up in pole insert location.

Deckmount—Insert—Ball & Socket Fitting

Inserts into "Deckmount—Snap-Fit—Housing" to provide the socket portion of the "ball & socket" type fit.

Could be used as an insert in "Deckmount—Snap-Fit—Housing" made of various materials including but not limited to plastic, stainless steel and zinc die cast.

Could be used in any receptacle designed to accept the insert thereby providing a "ball & socket" type fit.

Self-draining feature to prevent water build-up in pole insert location.

Snap Insert for Deckmount Fitting

Snap fits into bottom of "Deckmount—Insert—Ball & Socket" to prevent abrasion to the mounted surface due to abrasion between the surface and the ball end w/shank.

Provides a finished look to the "Deckmount—Insert—Ball & Socket".

Ball End w/Shank Fitting

Attached with adhesive, press fit, weld, etc. to pole end.

Provides a blunt finished end to pole.

Provides the ball end of the "ball & socket" type fitting. Positive locating for pole mounting.

Shank provides protection to end of pole.

Locking Pole End Tip Fitting

Attach to end of pole to allow for interlocking of pole and grommet. Raised portion of tip provides for interlocking between pole and grommet located on strap or fabric.

Finishes the end of the pole.

Non-Locking Pole End Tip Fitting

Attach to end of pole to allow for attachment of pole with grommet. Allows for slip fit between pole and grommet located on strap or fabric.

Finishes the end of the pole.

Front Mount for Forward Enclosure Fitting

Provides a means for attaching one or more poles to the front end of the boat's bow on a forward enclosure.

Mounts on horizontally top of boat deck or vertically above the boat's bow cushions.

With the structure according to the present invention, a portable cover unit can be easily and inexpensively manufactured to be attached to a vehicle or other structure and can also be used independently. Additionally, the cover unit can be readily disassembled and stored in a compact package.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A portable cover unit attachable to an open portion of a structure including a main frame, the portable cover unit comprising:

a fabric cover having an outer perimeter and an inside surface, the fabric cover being sized to cover the open portion of the structure;

a plurality of frame attaching members securable to the structure; and a flexible frame attachable to the structure via the frame attaching members, wherein the flexible frame includes at least two longitudinally extending primary frame members releasably attachable at ends thereof to the frame attaching members, and at least one laterally extending secondary frame member releasably attachable at ends thereof between the primary frame members, wherein the fabric cover includes a plurality of frame connectors fixed to the inside surface thereof, and structure associated with the outer perimeter that is coupleable with the main frame of the structure, the flexible frame being removably secured to the fabric cover via the frame connectors.

2. A portable cover unit according to claim 1, wherein the frame attaching members comprise at least one flange including an opening for receiving a connector and a receiving channel for releasably supporting the ends of the primary frame members.

3. A portable cover unit according to claim 1, wherein the primary frame members are formed of flexible tubing having a cross-sectional shape, and the at least one secondary frame member comprises end connectors at the ends thereof of a shape corresponding to the cross-sectional shape of the primary frame members and sized such that the end connectors are engageable with the primary frame members in a snap fit.

4. A portable cover unit according to claim 3, wherein the end connectors are press-fit onto the ends of the secondary frame member.

5. A portable cover unit according to claim 1, wherein the frame connectors comprise sleeves sewn to the inside surface of the fabric cover, the sleeves being sized to receive the primary frame members.

6. A portable cover unit according to claim 5, wherein the sleeves comprise a first fabric strip with one half of a hook and loop fastener material and a second fabric strip with the other half of the hook and loop fastener material, the first and second strips being hooked together to form the sleeves.

7. A portable cover unit according to claim 1, wherein the structure associated with the outer perimeter that is coupleable with the main frame of the structure comprises a cover connector releasably attachable to the main frame of the structure.

8. A portable cover unit according to claim 7, wherein the cover connector comprises one half of a snap connector, wherein the other half of the snap connector is secured to the main frame.

9. A portable cover unit according to claim 7, wherein the cover connector comprises a suction cup secured at an end of a strap attached to the fabric cover outer perimeter.

10. A portable cover unit according to claim 7, wherein the main frame is ground, and wherein the cover connector comprises a stake receptacle formed at an end of a strap attached to the fabric cover outer perimeter, the stake receptacle receiving a stake for securing the portable cover unit to the ground.

11. A portable cover unit according to claim 1, wherein the structure is a boat, and wherein the main frame is a boat hull.

12. A portable cover unit according to claim 11, wherein a forward portion of the fabric cover comprises a zipper for connecting with a brow bar of the boat.

13. A portable cover unit according to claim 12, wherein at least one of the frame attaching members comprises a brow bar connector fixed to the brow bar, the brow bar connector including an aperture therein that is sized to receive the primary frame members.

14. A portable cover unit according to claim 1, wherein the fabric cover comprises at least one transparent window.

15. A portable cover unit comprising:

a fabric cover supported by a flexible frame, the fabric cover having sleeves that secure members of the flexible frame, wherein the flexible frame comprises primary frame members extending in a first direction and at least one secondary frame member extending in a second direction substantially perpendicular to the first direction between the primary frame members;

a plurality of connectors attachable to an object to which the portable cover unit is installed, the connectors each comprising an aperture sized to receive the primary frame members; and means for releasably securing the fabric cover to the object to which the portable cover unit is installed.

16. A portable cover unit according to claim 15, wherein the securing means comprises snap connectors.

17. A portable cover unit according to claim 15, wherein the securing means comprises suction cups.

18. A portable cover unit according to claim 15, wherein the securing means comprises straps extending from the fabric cover.

19. A portable cover unit according to claim 15, wherein the sleeves comprise a first fabric strip with one half of a hook and loop fastener material and a second fabric strip with the other half of the hook and loop fastener material, the first and second strips being hooked together to form the sleeves.

* * * * *